United States Patent [19]

Oida et al.

[11] Patent Number: 4,711,105

[45] Date of Patent: Dec. 8, 1987

[54] WASHING MACHINE HAVING ROTARY BASKET IN WASHING TUB

[75] Inventors: Susumu Oida, Komaki; Yoshikazu Munemoto, Tajimi; Masami Ueda, Ichinomiya; Michiaki Ito, Seto, all of Japan

[73] Assignee: Kabushiki Kaisha Toshiba, Kawasaki, Japan

[21] Appl. No.: 793,339

[22] Filed: Oct. 31, 1985

[30] Foreign Application Priority Data

| | | | |
|---|---|---|---|
| Dec. 18, 1984 | [JP] | Japan | 59-266892 |
| Jan. 9, 1985 | [JP] | Japan | 60-1899 |
| Jan. 11, 1985 | [JP] | Japan | 60-3802 |
| Jan. 25, 1985 | [JP] | Japan | 60-9565[U] |

[51] Int. Cl.[4] ..... D06F 23/04; D06F 37/24

[52] U.S. Cl. ..... 68/23.2; 68/23 R; 68/174

[58] Field of Search ..... 68/23 R, 23 A, 23.2, 68/38, 53, 89, 136, 148, 154, 171–174

[56] References Cited

U.S. PATENT DOCUMENTS

| | | | |
|---|---|---|---|
| 2,652,710 | 9/1953 | DeRemer | 68/23.2 |
| 2,930,216 | 3/1960 | Cazzaniga | 68/23 R X |
| 2,986,916 | 6/1961 | Bochan | 68/23 R X |
| 3,603,118 | 9/1971 | Brucken et al. | 68/23 R |

FOREIGN PATENT DOCUMENTS

| | | | |
|---|---|---|---|
| 45394 | 8/1983 | Japan | 68/174 |
| 55296 | 3/1984 | Japan | 68/23 R |
| 2142937 | 1/1985 | United Kingdom . | |
| 2141742 | 1/1985 | United Kingdom . | |
| 2145435 | 3/1985 | United Kingdom . | |
| 2153394 | 8/1985 | United Kingdom . | |

*Primary Examiner*—Philip R. Coe

*Attorney, Agent, or Firm*—Cushman, Darby & Cushman

[57] ABSTRACT

A washing machine including a washing tub and a bowl-shaped agitator which is rotatably disposed in the lower part of the washing tub. The washing tub includes a ring-shaped frame element, which covers the gap between the bowl-shaped agitator and the inner surface of the washing tub, whose internal diameter is the same as that of the bowl-shaped agitator.

13 Claims, 9 Drawing Figures

FIG. 7.
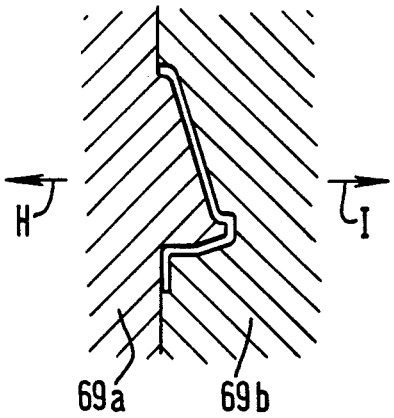
FIG. 6.
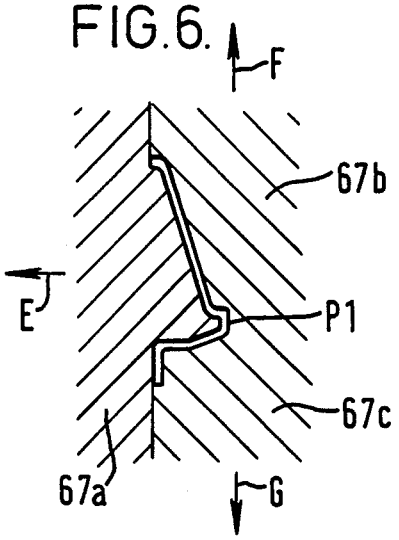
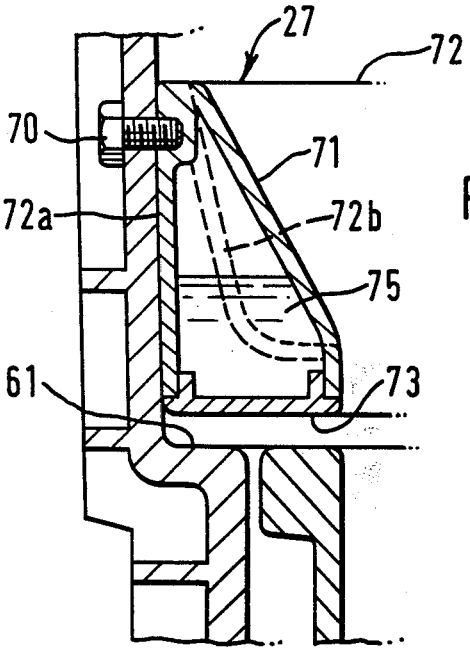
FIG. 9.

WASHING MACHINE HAVING ROTARY BASKET IN WASHING TUB

BACKGROUND OF THE INVENTION

1. Field Of The Invention

The present invention relates, in general to clothes washing machines. More particularly, the invention provides a washing machine with a basket-shaped agitator rotatably supported in its washing tub.

2. Description Of The Prior Art

A washing machine which has a rotary basket in its washing tub is disclosed in copending applications Ser. No. 606,149 filed May 2, 1984 in the name of Fumio TORITA, and entitled METHOD OF WASHING CLOTHES USING A WASHING MACHINE and Ser. No. 623,195 filed June 28, 1983 in the names of Shoich IMANISHI and Yoshio IKEDA and entitled WASHING MACHINE.

The washing machines of Ser Nos. 606,149 and 623,195 each have a bowl-shaped agitator which is rotated in alternating forward and reverse directions during washing. The agitator is disposed in the lower part of a washing tub which is itself also rotated during a spinning cycle of the washing machine. When the amount of clothes being washed is small, the clothes are turned by currents of water generated by the bowl-shaped agitator. When the amount of clothes is large, the clothes come into contact with the inner peripheral walls of the washing tub and bowl-shaped agitator, and are moved by frictional contacts between the clothes and the tub.

The above-described washing machine arrangement has certain operation advantages. For example, the various movements necessary for cleaning action can be obtained even when the amount of clothes being washed is large, thus the amount of clothes which can be washed at one time is increased. Excessive and inadequate cleaning can be avoided since the range of the amount of clothes within which adequate cleaning can be obtained is considerable. These advantages cannot be obtained with conventional washing machine, in which cleaning action takes place by generating water currents by rotation of a pulsator (a rotary vane) provided on the bottom surface of the washing tub, or by a difference in speed between the clothes and the water occurs when the washing tub, without any pulsators, is rotated intermittently. However, the above-described washing machine has a washing tub formed such that the internal diameter of the part thereof which is above the bowl-shaped agitator is the same as that of the bowl-shaped agitator in order to prevent the clothes from being drawn into the gap between the inner surface of the tub and the outer surface of the bowl-shaped agitator. With such a washing tub arrangement there is the problem that the amount of clothes that can be washed at one time is reduced because of the smaller diameter of the upper part of the tub.

SUMMARY OF THE INVENTION

It is an object of the present invention to provide an improved washing machine structural arrangement having an increased clothing capacity washing tub.

To accomplish this, the present invention provides a washing machine including a washing tub having an upper internal diameter that is larger than that of its lower part, a bowl-shaped agitator disposed in the lower part of the washing tub and a ring-shaped agitator, which covers the gap between the inner surface of the washing tub and the bowl-shaped agitator, whose internal diameter is the same as that of the bowl-shaped agitator.

BRIEF DESCRIPTION OF THE DRAWINGS

The invention will be better understood by reference to the accompanying drawings, wherein like reference numerals throughout the various Figures denoted like or corresponding structure elements and wherein:

FIGS. 6 and 7 are lateral sectional views of production dies for a ring-shaped frame element;

FIG. 9 is an enlarged sectional view of a ring-shaped frame element shown in FIG. 8.

DETAILED DESCRIPTION OF THE PREFERRED EXEMPLARY EMBODIMENTS

Preferred embodiments of the present invention will be now described in more detail with reference to the accompanying drawings.

Figure 1:
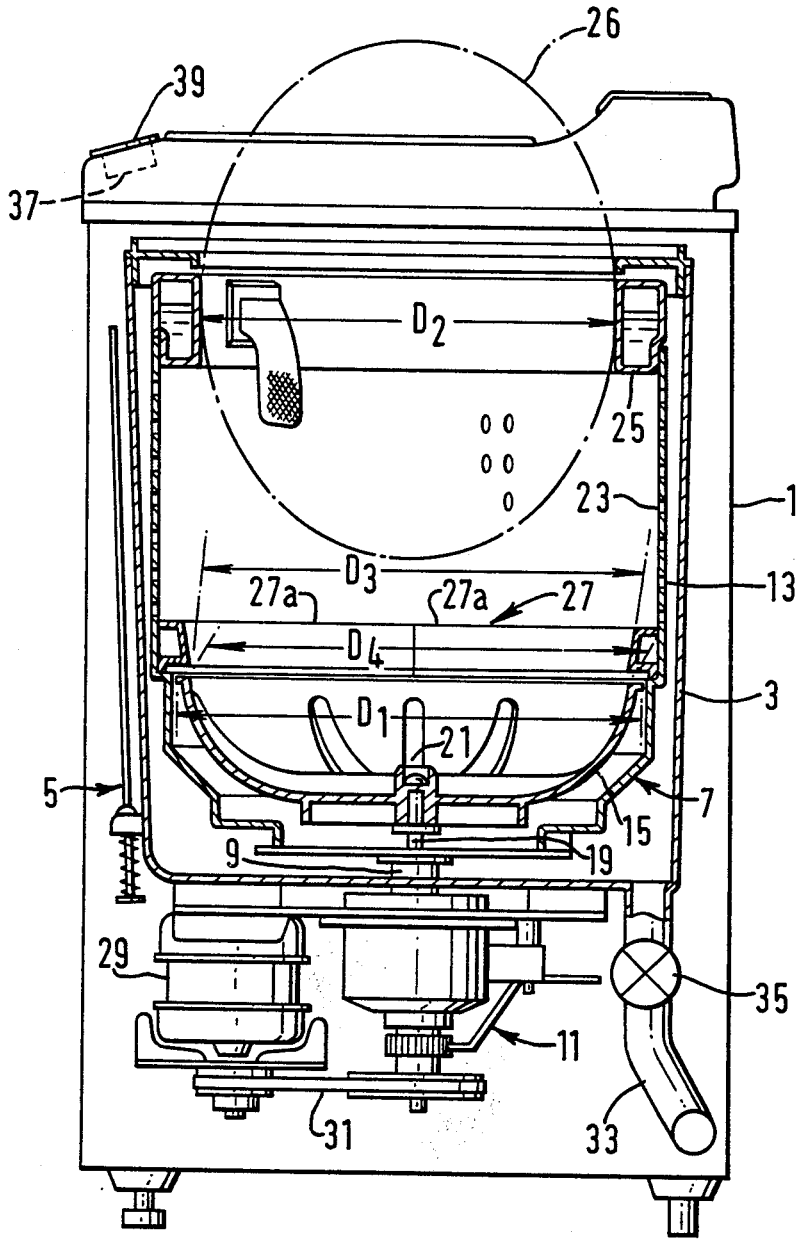
FIG. 1 is a lateral view, partly in section, of a washing machine according to one embodiment of the invention.

An overall assembly of the washing machine of this invention is shown in FIG. 1. Housing 1 includes a fixed tub 3 suspended by elastic suspension members 5. Elastic suspension members 5 absorb vibrations of fixed tub 3 during washing and spinning. A washing tub 7 disposed in fixed tub 3 is fixedly connected to rotary shaft 9 of a transmission 11. Washing tub 7 includes tub body 13, made of plastic, and a bowl-shaped agitator 15, which is located in the lower part of washing tub 7 and secured to a rotary shaft 19 by a screw 21. Tub body 13 is formed such that the upper part thereof, above bowl-shaped agitator 15, has a larger inner diameter than the lower part thereof where bowl-shaped agitator 15 is located. Tub body 13 has a plurality of openings 23 at its peripheral wall.

A ring-shaped balancer 25, in which liquid is contained, is provided to inside tub body 13 at its upper end. Bowl-shaped agitator 15 is formed from highly pliable plastic such as polypropylene. Though the outer diameter $D_1$ of bowl-shaped agitator 15 is larger than the inner diameter $D_2$ of balancer 25, the pliability of the material enables bowl-shaped agitator 15 to be deformed into an elliptical shape 26 of width slightly less than inner diameter $D_2$ of balancer 25. A ring-shaped frame element 27 is provided to the inner wall of tub body 13 such that the lower edge thereof is located closely above the upper edge of bowl-shaped agitator 15. The inner diameter of ring-shaped frame element 27 gradually becomes larger in the upward direction, and the inner diameter $D_3$ at its lower edge is the same as the inner diameter $D_4$ of the upper edge of bowl-shaped agitator 15. Ring-shaped frame element 27 includes two frame parts 27a. Each frame part 27a is formed in hollow-semicircular shape.

Transmission 11 includes a clutch mechanism, a brake mechanism and a speed-control mechanism (not shown) for transmitting the rotary movement from a motor 29 through a belt 31 to only rotary shaft 19 during washing operation or to both rotary shafts 9 and 19 during spinning operation in a conventional manner. During a washing operation, the rotation of tub body 13 is restrained by the brake mechanism and bowl-shaped agitator is rotated in forward and reverse directions in successively repeated cycles. The peripheral wall of tub body 13, above bowl-shaped agitator 15 serves as a fixed wall of washing tub 7 and bowl-shaped agitator 15 serves as a movable wall thereof. A drain hose 33 is provided on the bottom of fixed tub 3 and extended outside housing 1. A drain valve 35 provided in the intermediate portion of drain hose 33 enables the water in washing tub 7 to be drained to outside housing 1 through drain hose 33. A sequence controller 37, mounted on control panel 39, controls each process of washing automatically.

Figure 2:
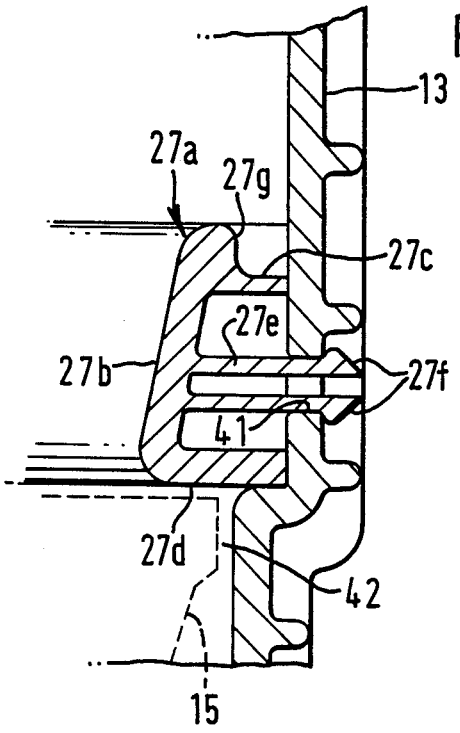
FIG. 2 is an enlarged sectional view of ring-shaped frame element shown in FIG. 1.

As can be seen in more detail in FIG. 2, frame element 27a includes a body 27b and upper and lower walls 27c and 27d, respectively, which extend, at right angles, from both ends of body 27b, respectively. A pair of legs 27e extend in the same direction as that of walls 27c and 27d from the intermediate portion of body 27b and include pawls 27f projecting outward from the ends thereof individually. The pair of legs 27e are provided to several places of body 27b along circumferential direction of flame element 27a. Hand grips 27g project from the top of body 27b at positions corresponding to pairs of legs 27e. Each of frame elements 27a are detachably mounted on the inner surface of tub body 13 in such a manner that pairs of legs 27e are snapped into individual holes 41 formed in the inner surface of tub body 13 as shown in FIG. 2.

During a washing operation, a gap 42 between the inner surface of tub body 13 and the outer surface of bowl-shaped agitator 15 is covered with ring-shaped frame element 27 thereby preventing clothes from being drawn into the gap. Ring-shaped frame element 27 does not cover the entire inner surface of tub body 13 above bowl-shaped agitator 15 but only a part of it. Thus, the volume of tub body 13 is not greatly reduced by ring-shaped frame element 27, and the washing capacity can be increased. When inspecting or repairing the apparatus, it may be necessary to take bowl-shaped agitator 15 out of tub body 13. In such case, the individual engagement between pawls 27f and holes 41 of tub body 13 are disengaged by pulling hand grips 27g inward and the frame elements 27a can be removed from tub body 13.

Bowl-shaped agitator 15 is then removed from rotary shaft 9. Then, bowl-shaped agitator 15 can be taken out from tub body 13 through balancer 25 by deforming it elastically into an elliptical shape 26.

Thus, even if the external diameters of ring-shaped frame element 27 and bowl-shaped agitator 15 are larger than the internal diameter of balancer 25, ring-shaped frame element 27 and bowl-shaped agitator 15 can be removed from tub body 13 through balancer 25, so that balancer 25 may not be removed from tub body 13 in every such case.

Figure 4:
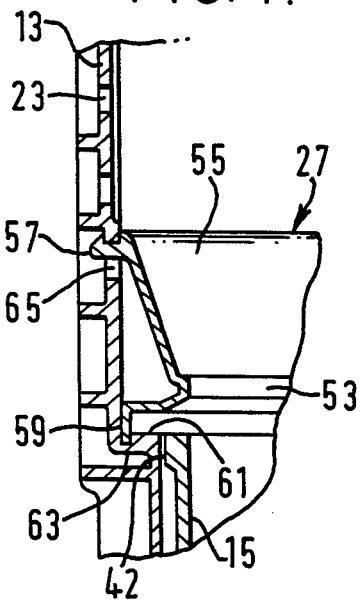
FIG. 4 is an enlarged sectional view of a ring-shaped frame element shown in FIG. 3.
Figure 5:
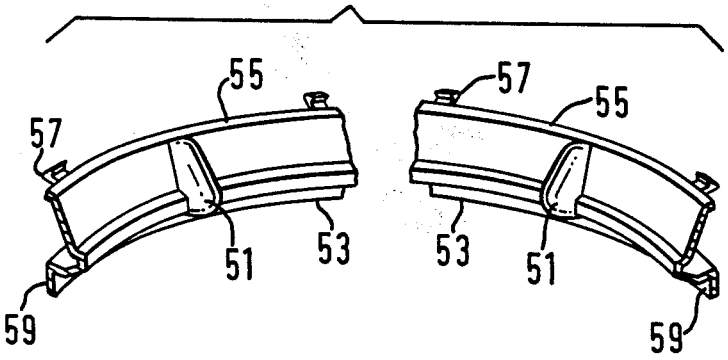
FIG. 5 is a perspective view of a ring-shaped frame element.
Figure 3:
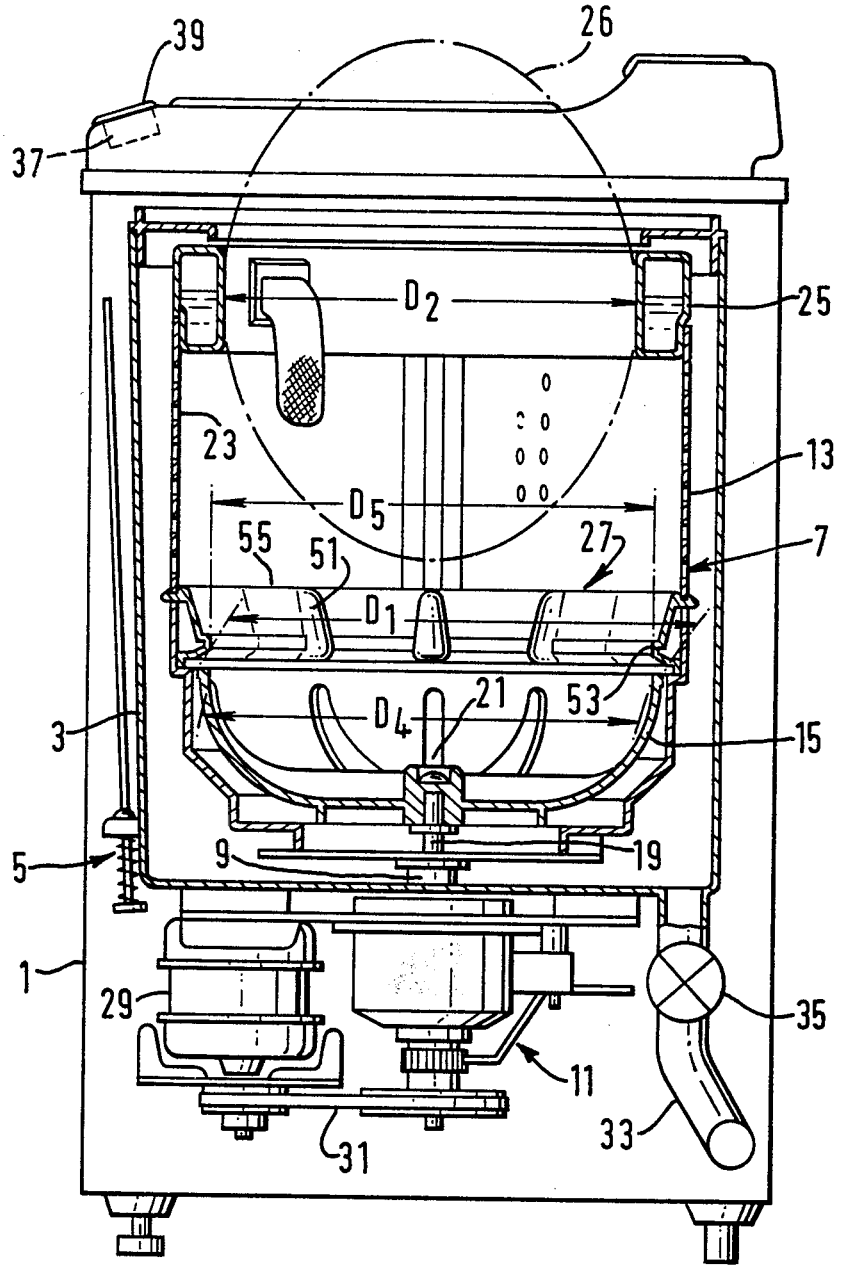
FIG. 3 is a lateral view, partly in section, of a washing machine according to a second embodiment of the invention.

The following describes ring-shaped frame element 27 of FIGS. 3 to 7 which show a second embodiment of the invention. As can be seen in FIG. 3, ring-shaped frame element 27 is provided to the inner wall of tub body 13 such that the lower edge thereof is located closely above the upper edge of bowl-shaped agitator 15. Ring-shaped frame element 27 includes projecting parts 51 extending vertically on the tapering inner surface and a flange 53 projecting inward, all round, at the lower end of the tapering inner surface thereof. The inner diameter $D_5$ of flange 53 is the same as the inner diameter $D_4$ of bowl-shaped agitator 15. Ring-shaped frame element 27 is divided, in the cirfumferential direction, into a plurality of frame sections 55, e.g. four. Each frame section 55 includes pawls 57 projecting outward from its upper part and an inserting flange 59 projecting downward from its lower part as shown in FIGS. 4 and 5.

Tub body 13 has a step part 61 which projects inward from the circumferential wall thereof and extends closely to bowl-shaped agitator 15. The upper surface of step part 61 is flush with the upper surface of bowl-shaped agitator 15. A groove 63 is formed, in circumferential direction, on the surface of step part 61. Engaging holes 65 are provided in the wall of tub body 13 such that each hole 65 corresponds to individual pawl 57 of frame section 55. Thus, each frame section 55 can be attached to tub body 13 by inserting flange 59 into groove 63 and snapping pawls 57 into engaging holes 65 as shown in FIG. 4. In the above description, though ring-shaped frame element 27 is divided in four sections. However, it may be formed as a single circular plastic piece. But, if it is to be formed in such a way, the production tool for the frame element would have to consist of an external die 67a, for which the withdrawal direction is outward along a diameter (the direction of arrow E in FIG. 6), an upper internal die 67b and a lower internal die 67c, for which the withdrawal directions are upward and downward individually (the direction of arrows F and G in FIG. 6). With this arrangement of the production tool, there would be parting line PL on the inner surface of ring-shaped frame element, where upper and lower internal dies 67b and 67c separate, whereupon there would be produced needless projections along the parting line PL. Consequently, the washing might be damaged by the projections during washing and rinsing.

In the second embodiment, however, since ring-shaped frame element 27 includes four frame section 55, production tool for frame section 55 can consist of an internal die 69a and an external die 69b, for which the withdrawal directions are inward and outward respectively (the directions of arrows H and I in FIG. 7). Therefore, the construction of the production tool is simpler and there is no parting line forming harmful projections on the surface of frame section 55. Furthermore, step part 61 of tub body 13 prevents the washing in tub body 13 from being drawn into the gap 42 between the inner surface of tub body 13 and the outer surface of bowl-shaped agitator 15 during spinning.

Figure 8:
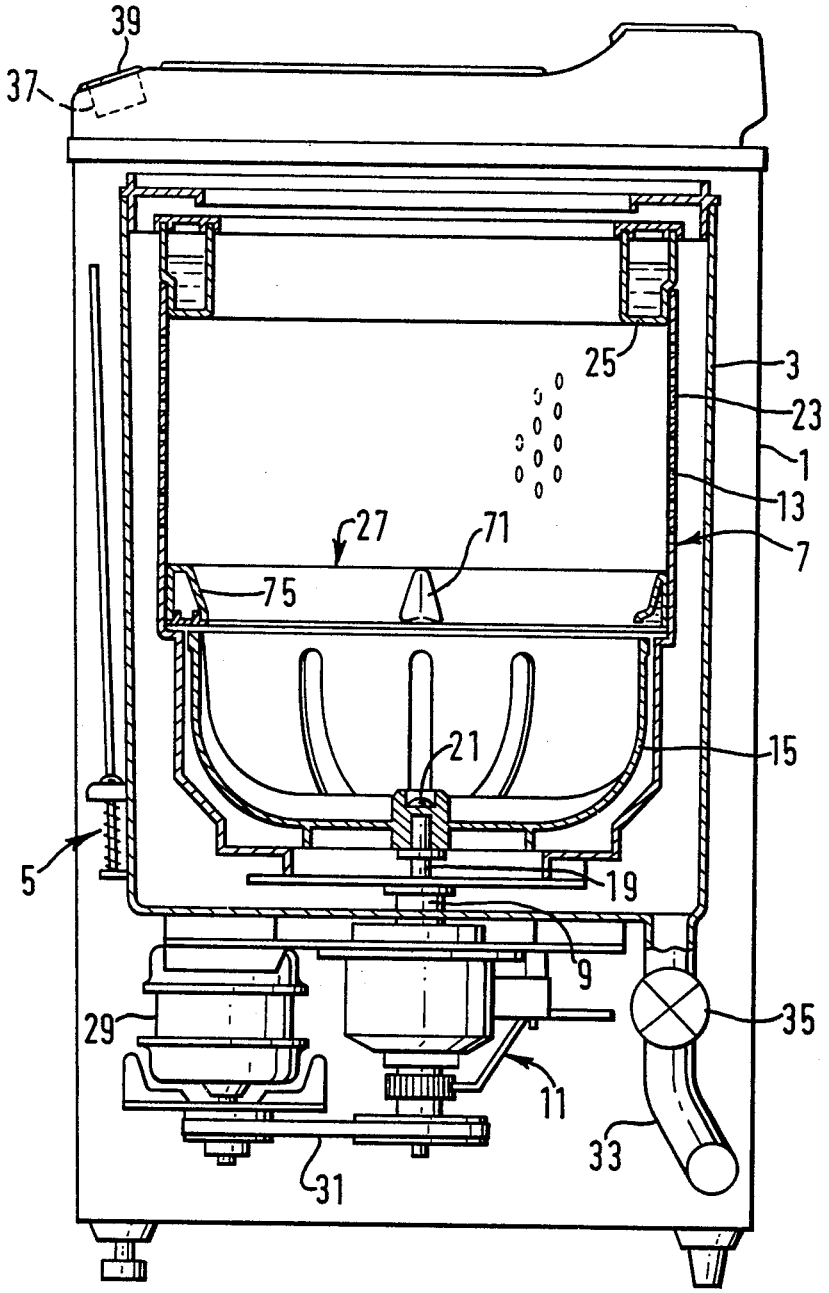
FIG. 8 is a lateral view, partly in section, of a washing machine according to a third embodiment of the invention.

The following describes frame element 27 of FIGS. 8 and 9 which show to a third embodiment of the invention. As can be seen in FIGS. 8 and 9, ring-shaped frame element 27 is provided relative to the inner surface of tub body 13 such that the lower edge thereof is located closely above the upper edge of bowl-shaped agitator 15 by screw 70. A plurality of projections 71 are provided, in a circumferential direction, on the surface of ring-shaped frame element 27. Ring-shaped frame element 27 includes a hollow main body 72 formed such that the bottom thereof is opened, the outer wall 72a is extended vertically and the inner wall 72b is sloped downward and a base plate 73 sealing the bottom of hollow main body 71. A balancing weight 75, e.g. liquid, is received in ring-shaped frame element 27.

In the above-identified constitution of the washing tub, during spinning operation, washing tub 7 and bowl-shaped agitator 15 are rotated at prescribed high speed in one direction, whereupon fixed tub 3 will be vibrated together with washing tub 7 due to the unbalanced load caused by an uneven distribution of clothes. However, the vibration of fixed tub 3 may be minimized because the uneven distribution of the clothes is compensated by the liquid in balancer 25 and ring-shaped frame element 27. In this type of washing machine, the height of washing tub 7 tends to be greater than the diameter thereof, in other words, the distance between balancer 25 and the center of gravity of the vibration system including fixed tub 3, washing tub 7, transmission 11 and motor 29 is greater, with the result that the vibration-suppression effect with only balancer 25 is not so effective. In this embodiment, however, the vibration of fixed tub 3 can be further reduced by the ring-shaped frame element 27, containing liquid, which is attached to intermediate portion of washing tub 7.

The weight for balancing purpose contained in ring-shaped frame element may use numerous balls instead of liquid. Furthermore, the present invention can be applied to a washing tub which does not have a spinning function, and in this case, the construction is such that the washing tub has no spinning holes, water is received therein, and thus the fixed tub is eliminated.

In summary, the present invention overcomes the disadvantages of the prior art and provides an improved washing machine which has large washing capacity. While the present invention has been disclosed in what is presently conceived to be the most preferred embodiments thereof, those in this art may recognize that many modifications may be made which shall be accorded the broadest scope of the appended claims so as to encompass all equivalent structures and assemblies.

What is claimed is:

1. A clothes washing machine comprising:
a housing including a fixed tub disposed therein;
a washing tub disposed in said fixed tub for receiving clothes to be washed;
a bowl-shaped agitator disposed in a lower part of said washing tub;
a ring-shaped frame element attached to an inner surface of said washing tub, said frame element covering a gap between said inner surface of said washing tub and an outer surface of said bowl-shaped agitator to prevent clothes from being drawn into said gap; and
a motor, provided in said housing, for driving said bowl-shaped agitator during washing and rinsing.

2. The washing machine according to claim 1 wherein said ring-shaped frame element is located closely above said bowl-shaped agitator.

3. The washing machine according to claim 2 wherein the internal diameter of said ring-shaped frame element is substantially the same as that of said bowl-shaped agitator.

4. The washing machine according to claim 3 wherein the inner diameter of said ring-shaped frame element is formed such that it becomes larger from its lower portion to its upper portion.

5. The washing machine according to claim 4 wherein said ring-shaped frame element includes a plurality of projections extending in a vertical direction and projecting outward relative to the inner surface thereof for increased scrubbing of the clothes.

6. The washing machine according to claim 5 wherein said ring-shaped frame element includes a flange projecting inward from the inner surface thereof so that an inner diameter of said flange is approximately equal to an inner diameter of said bowl-shaped agitator.

7. The washing machine according to claim 1 wherein said ring-shaped frame element is divided, in circumferential direction, into at least two elements.

8. The washing machine according to claim 1 wherein said ring-shaped frame element includes a hollow body containing a compensating weight for balancing said washing tub during spinning.

9. The washing machine according to claim 8 wherein said compensating weight is a liquid.

10. The washing machine according to claim 1 wherein the internal diameter of said upper part of said washing tub is larger than that of said lower part of said washing tub whereat said bowl-shaped agitator is disposed.

11. The washing machine according to claim 10 wherein said washing tub includes a step part which forms the circumferential surface of the lower part thereof and extends closely to said bowl-shaped agitator for preventing said clothes in said washing tub from being drawn into said gap between said inner surface of said washing tub and said outer surface of said bowl-shaped agitator during spinning.

12. The washing machine according to claim 11 wherein the upper surface of said step part is flush with the upper surface of said bowl-shaped agitator.

13. A washing assembly for use in a clothes washing machine comprising:
a fixed tub;
washing tub means, disposed in said fixed tub, for receiving water and the clothes to be washed, said washing tub means including a lower tub part and an upper tub part whose internal diameter is larger than that of said lower tub part;
agitator means, disposed in said lower tub part of said washing tub means, for agitating the water in said washing tub means; and
means, attached to an inner surface of said washing tub means, for covering a gap between said washing tub means and said agitator means so that clothes are prevented from being drawn into said gap.

* * * * *